US006394684B2

(12) United States Patent
Kapur et al.

(10) Patent No.: US 6,394,684 B2
(45) Date of Patent: May 28, 2002

(54) FASTENER FOR A FOLDER

(75) Inventors: Sumir Kapur, Oak Park; Scott Kouri, Chicago; Alvin Charles Skat, Jr., Elmhurst; Joshua Paul Goldfarb, Chicago; Scott S. Wolff, Evanston; Stephan Peter James Pfanner, Chicago; James Francis Caruso, Wilmette Evanston; Bart Massee, Chicago, all of IL (US)

(73) Assignee: ACCO Brands, Inc., Lincolnshire, IL (US)

( * ) Notice: Subject to any disclaimer, the term of this patent is extended or adjusted under 35 U.S.C. 154(b) by 0 days.

(21) Appl. No.: 09/759,450

(22) Filed: Jan. 16, 2001

Related U.S. Application Data

(63) Continuation of application No. 09/546,281, filed on Apr. 10, 2000.

(60) Provisional application No. 60/128,446, filed on Apr. 9, 1999.

(51) Int. Cl.[7] ..... B42F 13/02

(52) U.S. Cl. ..... 402/8; 402/12; 402/9

(58) Field of Search ..... 402/8, 9, 12, 13, 402/42, 46, 60

(56) References Cited

U.S. PATENT DOCUMENTS

| | | | | |
|---|---|---|---|---|
| 416,771 | A | 12/1889 | Wilson | |
| 971,519 | A | 10/1910 | Brannen | |
| 1,829,613 | A | 10/1931 | Sato | |
| 1,910,891 | A | 5/1933 | Freysinger | |
| 2,014,780 | A | 9/1935 | Powell | 129/41 |
| 2,559,556 | A | 7/1951 | Ambler | 128/41 |
| 2,773,504 | A | 12/1956 | McGervey | 129/41 |
| 2,936,980 | A | 5/1960 | Rapata | 248/74 |
| 3,127,648 | A | 4/1964 | Emery | 24/16 |
| 3,315,682 | A | 4/1967 | Bachman | 129/1 |
| 3,318,354 | A | 5/1967 | Borisof | 150/40 |
| 3,349,774 | A | 10/1967 | Ryan | 129/7 |
| 3,362,411 | A | 1/1968 | Moller | 129/1 |
| 3,363,412 | A | 1/1968 | Moller | 129/1 |
| 3,834,824 | A | 9/1974 | Jahn | 402/13 |
| 3,860,997 | A | 1/1975 | Van Riper, Jr. et al. | 24/16 PB |
| 3,910,708 | A | 10/1975 | Rohner | 402/80 R |
| 4,135,832 | A | 1/1979 | Saltz | 402/15 |
| 4,174,909 | A | 11/1979 | Jahn | 402/13 |
| 4,256,411 | A | 3/1981 | Podosek | 402/73 |
| 4,397,577 | A | 8/1983 | Bauer | 402/19 |
| 4,437,781 | A | 3/1984 | Weihe et al. | 402/8 |
| 4,693,624 | A | 9/1987 | Moosmüller | 402/22 |
| 4,775,257 | A * | 10/1988 | Rigg | 402/9 |
| 4,784,507 | A | 11/1988 | Vetter | 402/13 |
| 4,932,804 | A | 6/1990 | Richards | 402/75 |
| 5,167,463 | A | 12/1992 | Corbishley | 402/8 |
| 5,263,231 | A | 11/1993 | Sorensen et al. | 24/16 PB |
| 5,414,904 | A | 5/1995 | Sampson | 24/16 PB |
| 5,423,624 | A * | 6/1995 | Richards | 402/13 |
| 5,611,633 | A | 3/1997 | Whaley | 402/60 |
| 5,810,498 | A | 9/1998 | Hirai | 402/18 |
| 5,827,003 | A | 10/1998 | Konig | 402/13 |
| 5,836,054 | A | 11/1998 | Alexander | 24/16 PB |
| 6,168,337 | B1 * | 1/2001 | Adams | 402/8 |
| 6,146,749 | A1 * | 3/2001 | Chizmar | 402/42 |

* cited by examiner

*Primary Examiner*—Willmon Fridie, Jr.
(74) *Attorney, Agent, or Firm*—Pennie & Edmonds LLP

(57) ABSTRACT

A binder, with a first panel and at least one fastener. The fastener has a base attached to the panel and a binding member positionable in a closed position defining a closed loop, and in an open position in which the loop is open for mounting and dismounting sheets thereto. A lock is disposed in close proximity with the base and in releasable locking association with the binding member in the closed position. A lever is operatively connected with the lock such that depressing the lever in an unlocking direction causes the lock to release the binding member from the closed position.

27 Claims, 8 Drawing Sheets

FASTENER FOR A FOLDER

This application is a continuation of application Ser. No. 09/546,281, filed Apr. 10, 2000, which claims the benefit of provisional Application No. 60/128,446, filed Apr. 9, 1999.

BACKGROUND OF THE INVENTION

Traditional report covers are of a low cost construction and have front and back covers that can be placed around a stack of paper. The covers are bound to the stack such as by stapling, attaching two bars of plastic with extensions that extend through the covers and holes in the stack, or attaching a flexible spine of sheet plastic with curved extensions extending through holes in the stack.

U.S. Pat. No. 4,135,832 teaches a binder with a retaining apparatus made of a resilient sheet material. The apparatus has leaf holders that extend through leak apertures and are wedged between a cover and a tab of the apparatus.

U.S. Pat. No. 3,362,412 shows a loose leaf binder with plastic retaining members. A tongue with protuberances that extends through apertures in loose leaf sheets attaches to a body portion. The body portion must be forced into a curve to unlock the tongue. Also, the portion that must be so manipulated is positioned away from the spine of the binder with respect to the root end of the tongue.

SUMMARY OF THE INVENTION

The invention is directed to a binder that has a first panel and at least one fastener. The fastener has a base attached to the panel and a binding member positionable in a closed position defining a closed loop, and in an open position in which the loop is open for mounting and dismounting sheets thereto. A lock is disposed in close proximity with the base and in releasable locking association with the binding member in the closed position. A lever is operatively connected with the lock such that depressing the lever in an unlocking direction causes the lock to release the binding member from the closed position. In one embodiment, the lever comprises a single button, and in another, it includes two levers that can be squeezed together to unlock the binding member. Also, the button is preferably disposed near an edge of the panel to facilitate its operation when the top sheet of the stack is visible on top of the stack and on the panel. This construction can be provided as a low cost report cover.

The loop of the preferred embodiment is defined by both the binding member and the base. The base of this embodiment includes a surface defining the inside of the loop. This surface has a recessed portion and an elevated portion adjacent each other to increase the inside diameter of the loop. The binding member preferably meets the base adjacent the elevated portion and remotely from the recessed portion.

DETAILED DESCRIPTION OF THE PREFERRED EMBODIMENTS

Figure 1:
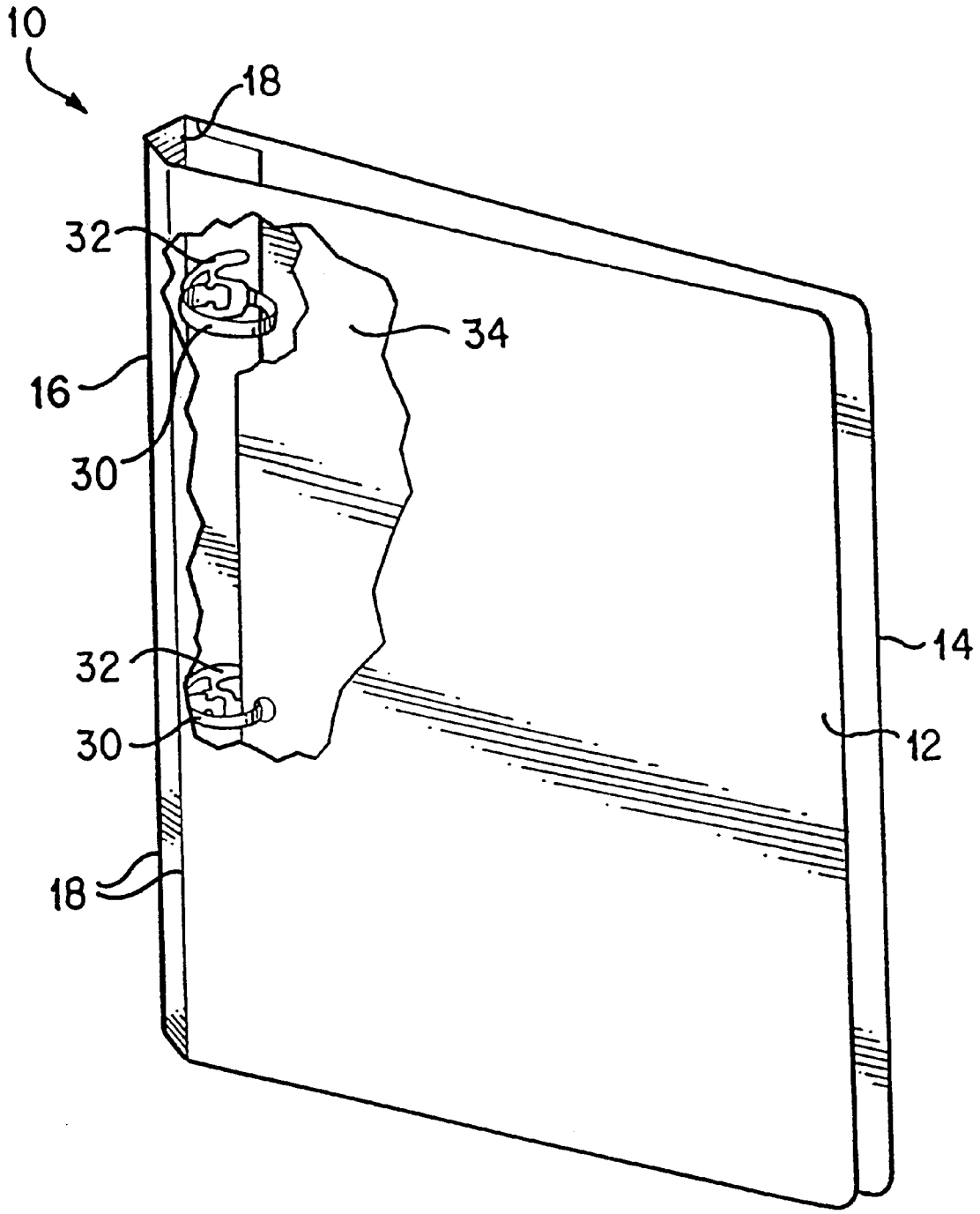
FIG. 1 is a cutaway perspective view of a folder having fasteners according to the invention.
Figure 2:
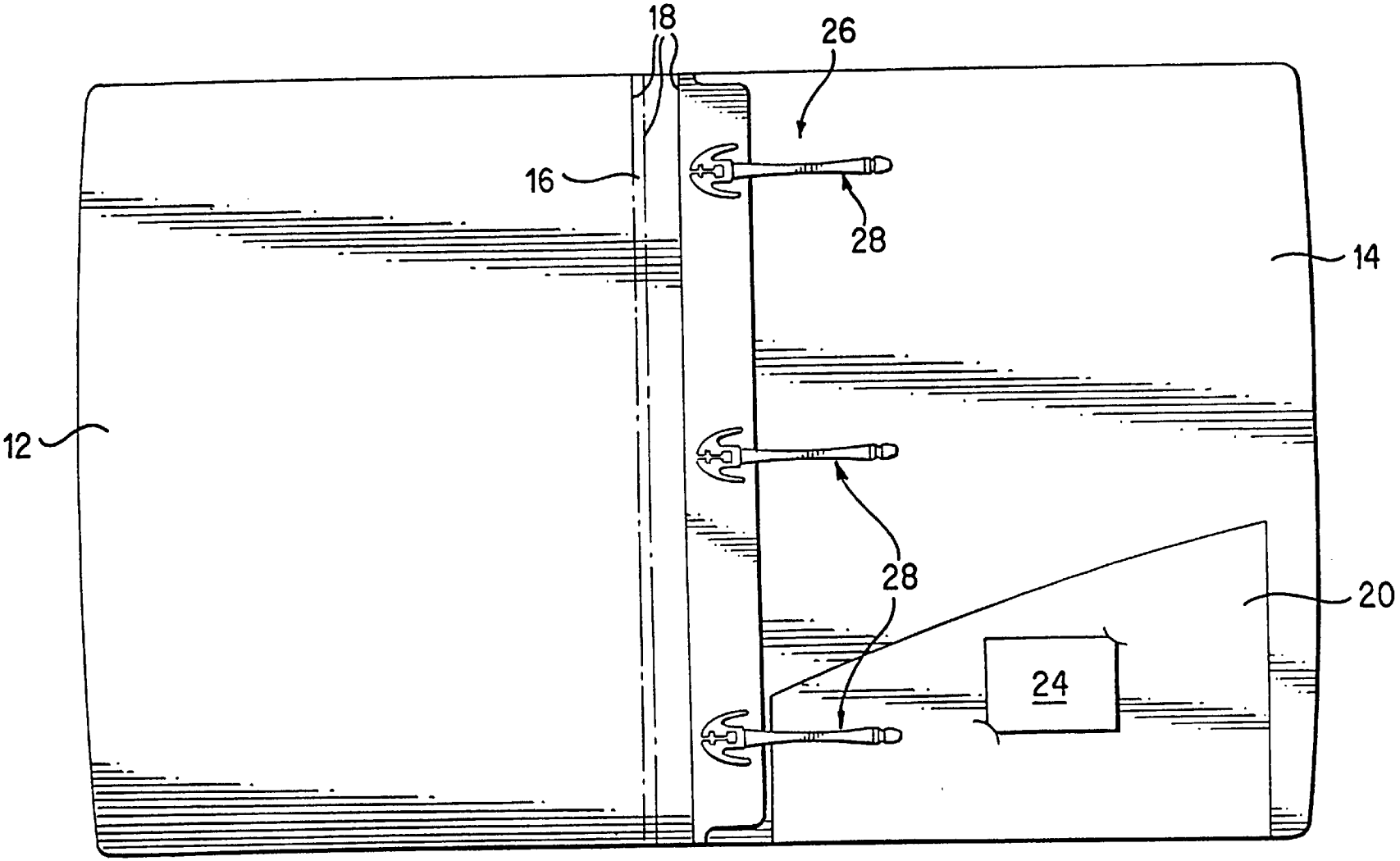
FIG. 2 is a front view of the folder in open position.
Figure 3:
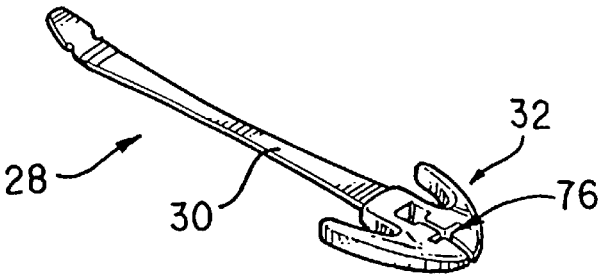
FIG. 3 is a perspective view of one of the fasteners.
Figure 4:
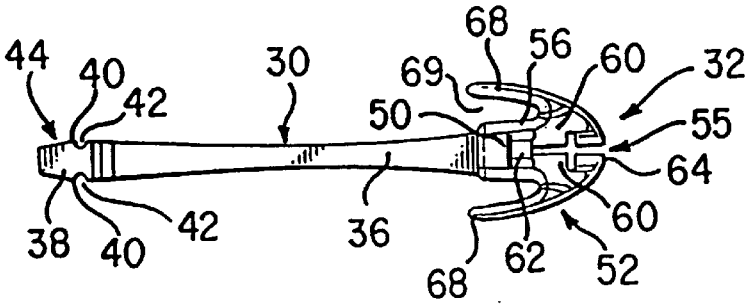
FIGS. 4–7 are a front, top, back, and left-side view, respectively, thereof.
Figure 7:
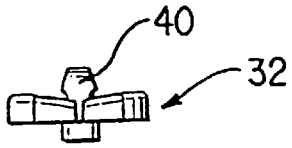
Figure 5:
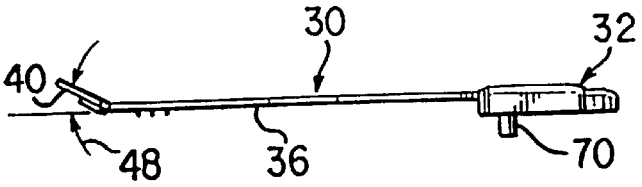
Figure 6:
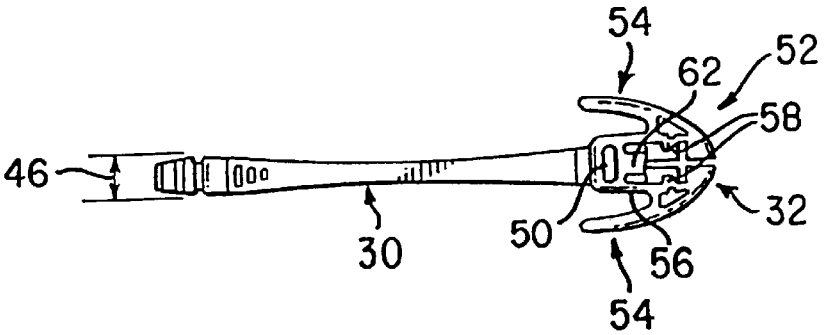

Referring to FIGS. 1 and 2, a preferred embodiment of the invention is shown, which includes a folder 10, such as a report cover, with at least one panel and preferably including front and back covers 12 and 14, which are pivotably connected to each other by a hinge 16, which is preferably a living hinge. In another embodiment, only a single panel is provided. The front cover preferably is a transparent plastic sheet with score lines 18, which are foldable to provide the hinge 16. The back cover 14 is preferably a sheet of a paper material, such as manilla or kraft paper, and includes a pocket 20 on the interior thereof for holding papers, and a pair of preferably arcuate cuts 22 on the front of the pocket for holding the corners of a business card 24.

The folder 10 also includes a binding mechanism 26, which itself includes fasteners 28. Preferably, the folder 10 has three fasteners 28 disposed adjacent the hinge 16. The fasteners 28 are preferably mounted to the back cover 14 independently and separately from each other. Referring to FIGS. 3–7, each fastener 28 includes a base 32 and a binding member, which preferably comprises a band portion 30. The base is preferably substantially stiff and can hold its general shape when operated and locking the band 30. The fastener 28 is preferably molded from a single piece of flexible and resilient plastic, such as polypropylene or nylon. The band portion 30 has a width sufficient to fit through holes of a standard size stack of paper 34, as shown in FIG. 1. The band 30 includes a loop portion 36 and a head 38. The loop portion 36 has a narrower portion at its center for facilitating the sliding of papers from a paper stack 34 about the loop when it is in a closed position. The head 38 has two locking tabs 40 extending laterally therefrom. A notch 42 is formed between each tab 40 and the loop portion 36. The head 38 has a leading edge 44 that is tapered in a direction opposite from the loop portion 36. The widest portion of the head 38, at the tabs 40, has a width 46. As set in FIG. 5, the head portion 38 is angled with respect to the loop portion 36 in a forward direction at angle 48, which is preferably between about 10° and 60°, and more preferably between 30° and 50°.

The base 32 has a central portion 50 connected to a locking portion 52 that includes two clamp halves 54, which are separated by a slot 55 and pivotably connected to the central portion 50 by resiliently flexible arms 56. The base 32 includes a lock. In this embodiment, the lock is formed in part by each clamp half 54, which has a locking tab 58 that corresponds to and is receivable in grooves 42 of the band portion 30. Front retaining platforms or tabs 60 are disposed on the front side of the clamp halves 54, extending inwardly towards slot 55. On the back side of the base 32, extending longitudinally towards the clamp halves 54, is a back retaining platform or tab 62, which preferably extends across the slot 55 in alignment therewith. At the left longitudinal ends of the clamp halves 54 are inwardly extending loop retaining platforms or tabs 64, which face the slot 55. The loop retaining platforms 64 are preferably disposed towards the back side of the clamp halves and include a forward sloped surface 66, configured such that the loop retaining platforms 64 are tapered toward the back retaining platform 62. Platforms 62,64 are preferably guiding members to cooperatively guide the head 38 into the locked position.

Figure 10:
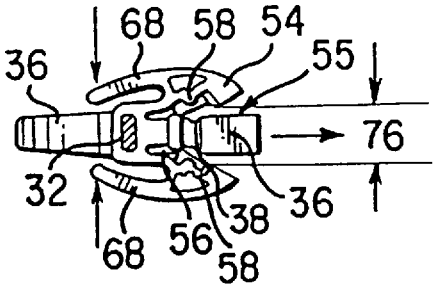
FIG. 10 is a back view of one of the fasteners with a base thereof being disengaged from a band portion thereof.

Levers 68 extend from the outer edges of the clamp halves 54, with respect to the slot 55, towards the band 30. Spaces 69 is defined adjacent the levers 68 and disposed such that the levers 68 are movable into the spaces 69 for operating the lock. The lever 68 preferably extends longitudinally beyond the flexible arms 56, such that application of a bias inwardly on the ends of the levers 68 causes the flexible arms 56 to bend and the clamp halves 54 to separate about slot 55, as shown in FIG. 10. Preferably, this inward movement of the levers 68 is generally parallel to the cover 14. As such, the levers are constructed as oppositely facing buttons, which unlock the band 30 simply by depressing the buttons, each button being depressed with a single finger.

Figure 8:
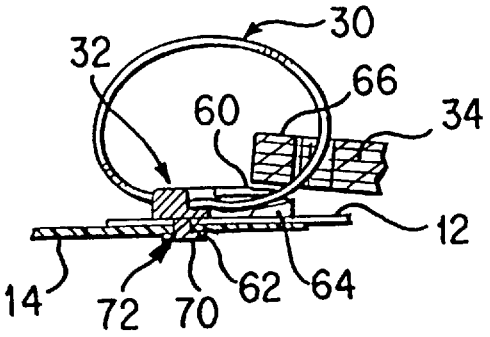
FIGS. 8 and 9 are a cross-sectional top view and a back view thereof in a closed position.

The base 32 also has a post 70 extending from the back side of the central portion 50. As shown in FIG. 8, the post extends through holes 72 in both the front and back covers 12 and 14, and the end of the post 70 is heated and flattened to heat-stake the front and back covers 12 and 14 together, preferably without requiring any further attachment, such as an adhesive, to connect the front and back covers 12 and 14.

Figure 9:
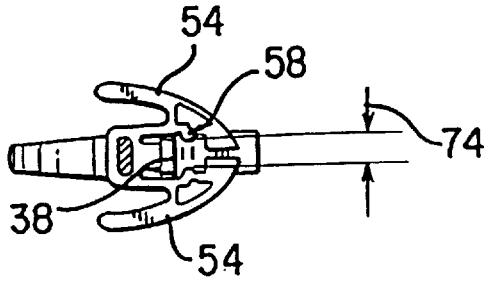

FIGS. 8 and 9 show the band 30 in a closed position. The head 38 is received between the clamp halves 54, and is inserted forward of the back and loop retaining platforms 60 and 64 and behind the front retaining platform 60. The tabs 40 are engaged against the corresponding tabs 58, locking the band 30 to the base 32 in the closed position, in which the loop portion 36 forms a closed loop for retaining the stack of paper 34. In the closed position, papers from the stack 34 can be moved about the loop as in a standard ring binder.

The head 38 and the adjacent portion of the loop portion 36 are lockably retained in the base 32, between the retaining portions 60, 62 and 64 and the locking tabs 58. The retaining platforms 62 and 64 located at the back of the base, especially the back retaining platform 62, advantageously provide a stiffer and more solid surface than the flexible covers 12 and 14 of the folder 10 to maintain the head 38 locked in the closed position. The width 46 of the head 38 is wider than the width 74 between the locking tabs 58, but the width at the tip of the head 38 is preferably narrower than the opening 76 between the clamp halves 54 and above the loop retaining platforms 64, to enable the head 38 to be slid into the opening 76 with the tapered edges 44 of the head 38 camming the locking tabs 58 outwardly, which are also tapered towards the opening 76. The angle 48 of the head portion 38, with respect to the loop portion 36, helps retain the bend 30 in the locked position shown within the base 32 and also facilitates insertion of the head 38 through the space between the retaining platforms to curve forward of the back retaining platform 62.

Referring to FIG. 10, when levers 68 are compressed or squeezed towards each other, the clamp halves 54 are pivoted away from each other, spreading the slot 55, and bending the flexible arms 56 about a pivot point which is preferably disposed within the arms 56. In the unlocked position shown in FIG. 10, the locking tabs 58 are separated by a distance 76, which is greater than the width 46 of the head 38. Thus, the head 38 is allowed to be extracted from the base 32 towards an open position, in which the stack 34 is mountable to and demountable from the fastener 28.

Figure 11:
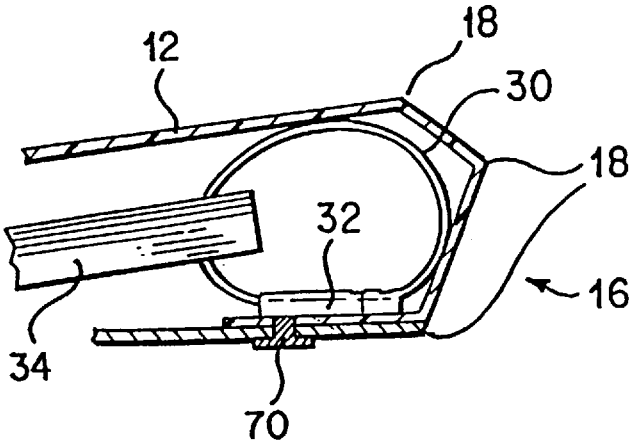
FIG. 11 is a cutaway top view of the binder.

The embodiment shown in FIGS. 1 and 2 includes three fasteners 28, although a different number of fasteners may be provided to mount different sizes of papers with holes spaced at different intervals. Also, the pair of score lines 18 positioned closest to the fasteners 28 are spaced at a greater distance than the pair score lines 18 which are farthest from the fasteners 28. This allows the front cover 12 to bend more naturally around the loops 36 when in the closed and locked position, as shown in FIG. 11, although the score lines 18 may be spaced by common distance. Additional or fewer score lines or other types of folding lines may also be provided to further facilitate bending of the cover around the closed loop portion 36.

Figure 12:
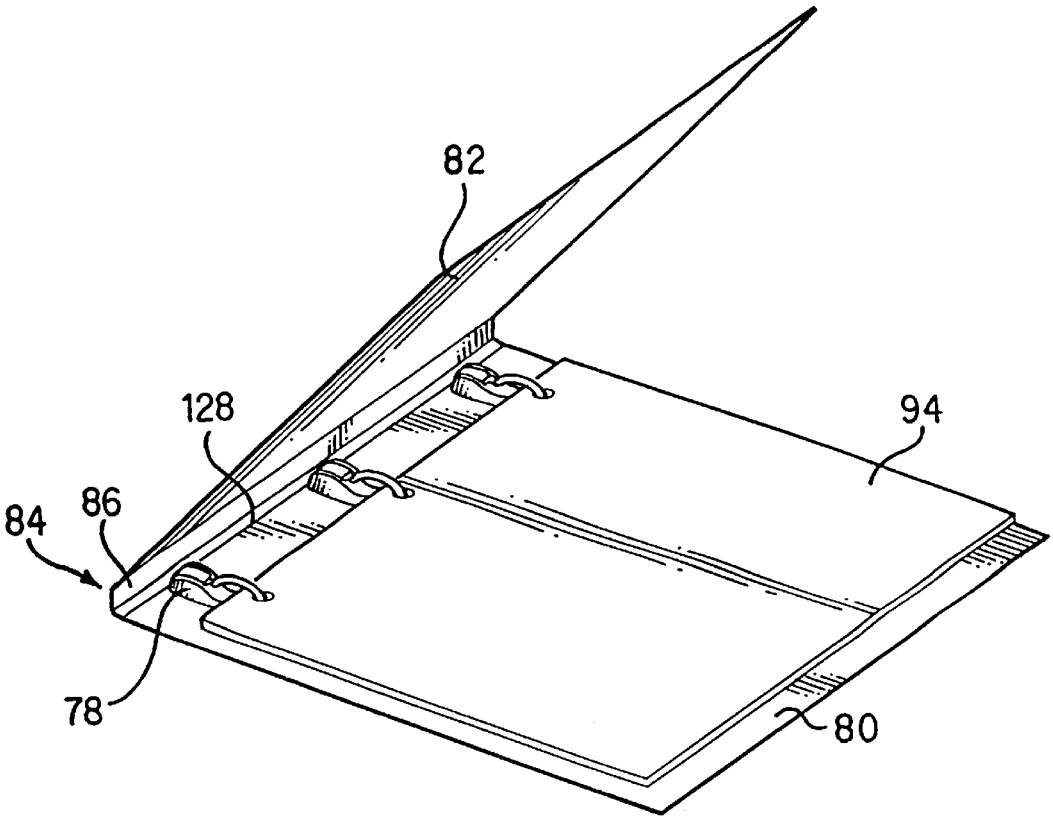
FIG. 12 is a perspective view of another embodiment of a folder with fasteners constructed according to the invention.
Figure 13:
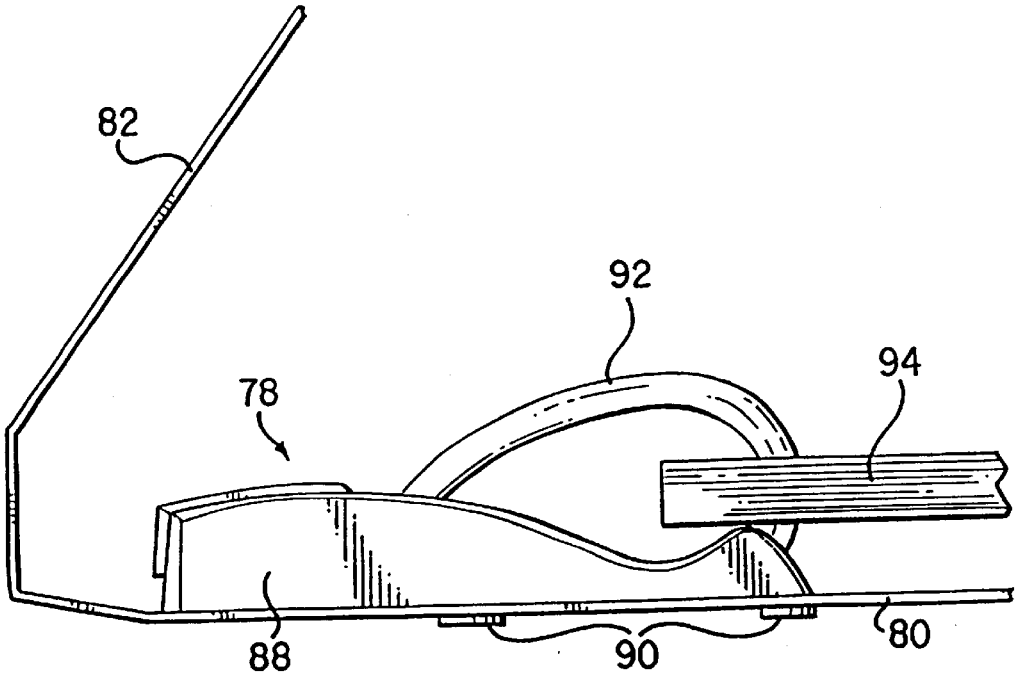
FIG. 13 is a side view of one of the fasteners with a mounted stack.

Referring to FIG. 12, the embodiment shown includes three fasteners 78 mounted preferably independently from each other and separately to back cover 80, which is pivotably attached to front cover 82 by a hinge 84 in a spine area 86 of the folder. Preferably, the fasteners are mounted to only one of the covers and do not depend from the other cover. As shown in FIG. 13, each fastener 78 has a base 88 attached to the back cover 80 by heat stakes 90, although other attachments can be used, such as rivets.

Figure 14:
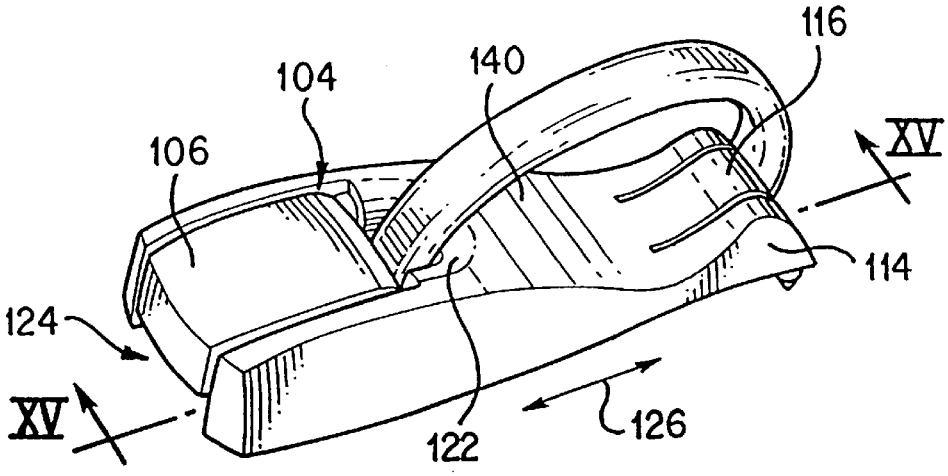
FIG. 14 is a perspective view of the fastener.
Figure 15:
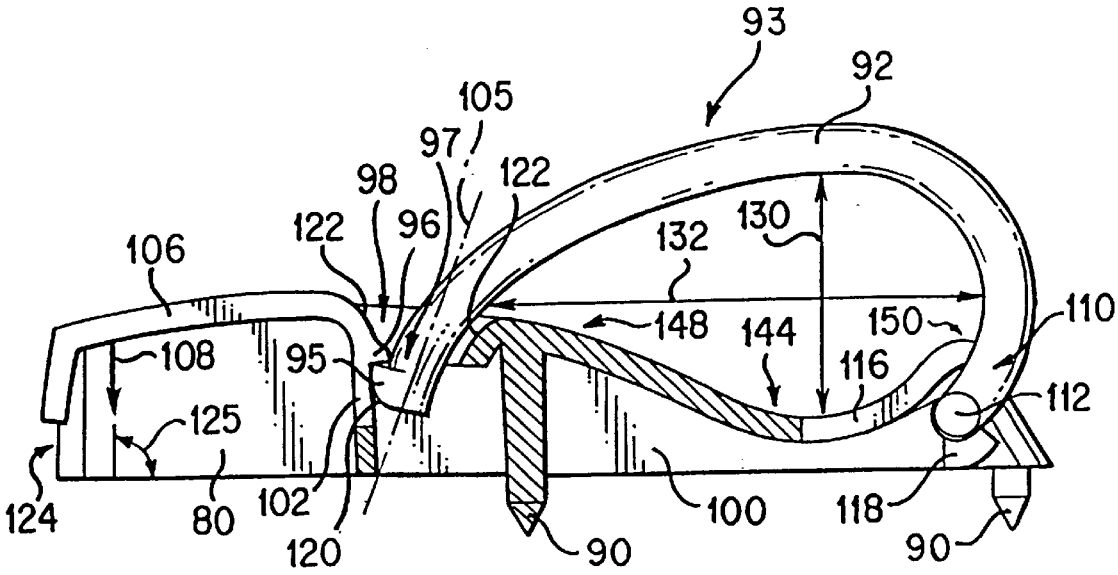
FIG. 15 is a cross-sectional view thereof along line XV—XV.

FIGS. 13–15 show the fastener 78 with a binding member, which preferably comprises a band 92, in a closed position. The band 92 is shown received through holes in a stack of paper 94. Whereas the band 30 of the first embodiment is relatively flexible, the band 92 is relatively stiffer and has a rounded cross-section, and requires more force to resiliently deform. The heat stakes 90 in FIGS. 13–15 and also in 16–18 are shown prior to deformation and mounting to the folder.

Figure 17:
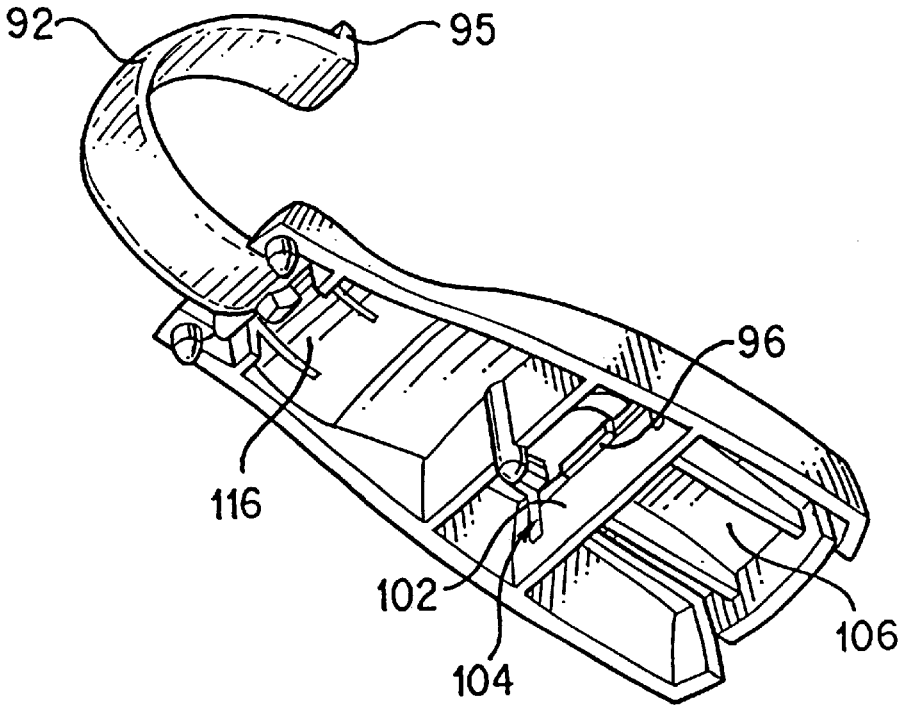

The band 92 has a locking tab 95 extending radially therefrom in a free, locking portion of 97 of the band 92. The locking tab 95 is locked and held in locked association beneath locking tab 96 of lock 98 in close proximity to the base 88, and preferably within the base. The lock 98 is preferably located in the base and near the cover 80, similarly to the first embodiment, and also preferably does not rely on the cover 80 to retain the locked band 92. The lock 98 is connected to the fixed portion 100 of the base by a flexible, resilient member 102, which served as a pivot and is connected to a wall of the base 88 at the bottom end of the flexible member 102, and separated laterally from the base 88 by slots 104, seen in FIG. 17. When locked in the closed position, the axis 105 of the leading portion of the binding member 92, including the locking portion 97, is preferably disposed at an angle of greater than about 30 degrees to the cover 80, and more preferably greater than about 60 degrees. In one embodiment, the leading portion is generally normal to the cover 80.

Figure 16:
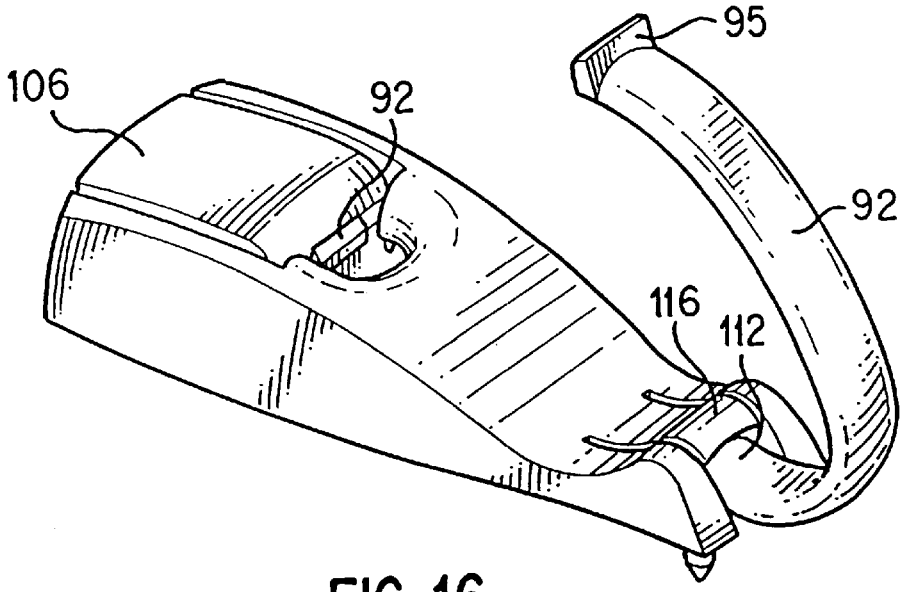
FIGS. 16–18 are top perspective, bottom perspective, and cross-section views thereof in an open position.

A single lever 106, constructed as a button, is operatively connected to the lock 98 and flexible member 102 such that depressing the lever in an unlocking direction 108, which in this embodiment is downwardly into the base and towards the back cover 80, causes the lock 98 to release the band 92 from its closed position. Simply depressing the lever 106 displaces the locking tab 96 from its interference relationship with the tab 95 of the band 92, allowing the band 92 to move from its closed position to the open position shown in FIGS. 16–18. Preferably, the base 88 is constructed integrally, and more preferably, as a unitary piece, with the lock, lever, as well as heat stakes, such that any movable parts are flexibly connected to the supportive portion of the base. Thus, the lever and lock are preferably fixed to each other.

Figure 18:
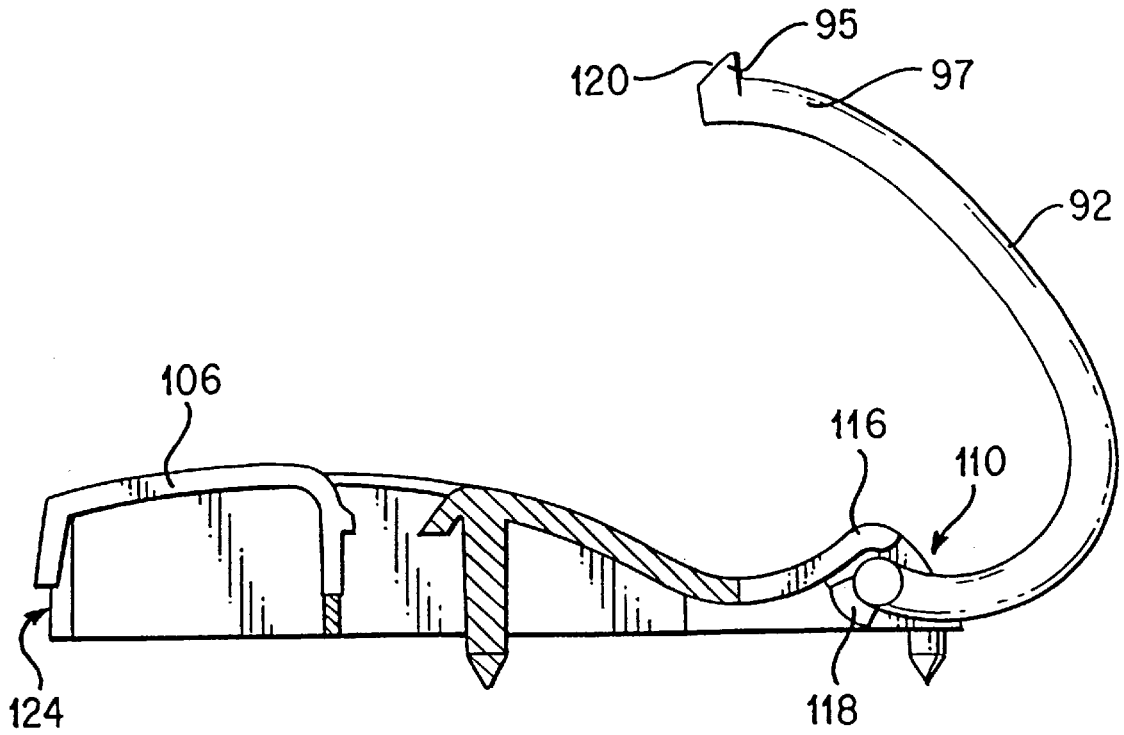

In the closed position, the band 92 forms a closed loop 93, preferably together with the base 88, to secure the paper stack 94. The band 92 has a base end 110 connected with the base 88. The base end 110 is pivotably connected to the base 88 by laterally extending rods 112, which are received brackets 114 of the base 88. In the closed position, a spring 116 on the top of the base 88 resiliently engages the band 92 to resiliently bias the band toward its open position. The spring 116 is also preferably a unitary part of the base, substantially free at its lateral edges. The band 92 also includes a stop 118 on the base end 110 to engage the spring 116 or another part of the base 88 when the band 92 reaches its open position, as shown in FIG. 18, to resist further pivotable movement further from the closed position.

Band 92 has a sloped, preferably tapered surface 120 at its free leading edge, and the base 88 preferably also has surfaces 122 sloped with respect to the direction of relative movement between the band 92 and the base 88 from the open to the closed positions. The sloped surfaces 122 of the base 88 is preferably part of a guiding portion configured for guiding the free portion 97 into the locked association, retained by the lock 98 in the closed position. Thus, the band 92 can be moved into the locked association in the closed position in snap-fit relation to the lock 98, and with a single hand when the folder is lying on a table. Upon closing the band 92 into the lock 98, the lock 98 and the locking portion 97 automatically engage in the locking association. The guiding portion is preferably of unitary construction with the base 88.

When the lever 106 is depressed in the unlocking direction 108, the locking tab 96 of the lock 98 is moved away from the locking tab 95 of the band 92, and the spring biases the band 92 out of its locking position. A button space 124 is defined adjacent the lever 106 and disposed such that the lever 106 is movable into the space 124 for operating the lock 98. The space 124 may be empty, or can include a substantially softer material that is deformable upon depressing of the lever 106, but the lever 106 is preferably spaced from the back cover 80 for movement towards the lever 80 to operate the lock.

The unlocking direction 108 is preferably oriented at an angle 125 to the a longitudinal direction 126 of the base 88, which extends through both ends of the band 92 and rap is aligned with the plane of the loop. Preferably, angle 125 is greater than about 45 degrees, more preferably greater than about 70 degrees, and most preferably, the unlocking direction 108 is substantially normal to the base longitudinal axis. In this embodiment, the unlocking direction 108 is directed towards the back cover 80.

The preferred construction of the fastener can be unlocked and opened upon simple depression of the lever 106 in the unlocking direction 108 with a single finger, and thus does not require complex manipulation to unlock or lock. The lock 98 and the flexible member 102, however, are sufficiently stiff to resist unintentional opening by pressures on the lever 106 lighter than a preselected threshold value.

Referring again to FIG. 13, the back cover 80 has a spine edge 128 to which the front cover 82 is attached, and the fasteners 78 are attached adjacent thereto. The base end 110 of the band 92 is connected to the base at a base location that is further from the spine edge 128 than the locking end 97 when in the closed position. Thus, with the stack positioned so that the front page is on top of the stack, the lever 106 is exposed and operable.

As shown in FIGS. 13–15, the band 92 and base 88 have shapes such that the closed loop has a height 130 that is shorter than the length 132 of the loop. This configuration is selected so that the fasteners lie flatter than with perfectly round loops, but the length of the loops is maintained to enable opposite halves of the stack 94 to lie on each cover 80, 82 without interfering with each other inside the loop. To ensure the proper loop size, the band 92 is preferably releasably lockable to the base at a single location and with a single loop size, such as with a single set of locking tabs as shown in the preferred embodiments, although alternative embodiments are selectively lockable at a plurality of locations, such as with various locking tabs.

Figure 19:
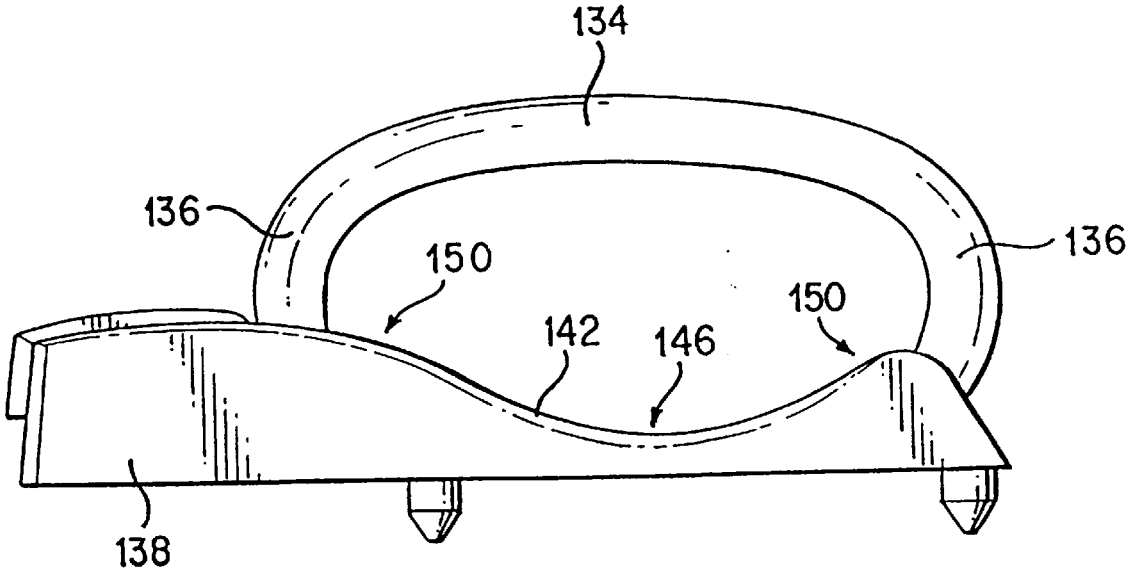
FIG. 19 is a side view of another embodiment of the fastener.

Another embodiment with a differently shaped loop is shown in FIG. 19. In this embodiment, the loop 134 has substantially symmetrical sides 136 to facilitate turning of the sheets in a mounted paper stack.

Referring to FIGS. 15 and 19, the base 88, 138 of each embodiment has a surface 140, 142 generally facing in the direction of the loop 93, 136. Each surface 140, 142 preferably has a recessed, concave portion 144, 146, positioned between elevated portions 148, 150, which are preferably convex. The band 92 meets the base 88 adjacent one of the elevated portions 148, 150, preferably adjacent both elevated portions 148, 150, and remotely from the recessed portion 144, 146. These recessed and elevated portions are disposed and configured to facilitate turning of the sheets of a mounted stack. To maximize the interior height of the loops 93, 134, the lowest portion of the recessed portions 144, 146 are disposed substantially beneath the highest portion of the loops 93, 134 with respect to the panels to which the fasteners are attached. Thus, the lowest or deepest portion of the recessed portion 144 of the first embodiment is disposed closed to the base end 110 of the band 92 than in the second embodiment. The height and aspect ratio, of length to height, of the loop can thus be altered by changing the height of the base and band. The preferred aspect ratio is between about 1.5 to 3.

One of ordinary skill in the art can envision numerous variations and modifications. All of these modifications are contemplated by the true spirit and scope of the following claims.

What is claimed is:

1. A binder, comprising:

(a) a first panel; and (b) at least one fastener comprising:

(i) a base attached to the panel;

(ii) a binding member positionable in a closed position defining a closed loop, and in an open position in which the loop is open for mounting and dismounting sheets thereto, (iii) a lock disposed in close proximity to the base and being in releasable locking association with the binding member in the closed position, and (iv) a lever operatively connected with the lock such that depressing the lever in an unlocking direction causes the lock to release the binding member from the closed position.

2. The binder of claim 1, wherein the lever and the lock are substantially fixed to each other.

3. The binder of claim 2, wherein the lever and lock are pivotably connected to the base at a pivot such that the lever and the lock pivot about the pivot upon said depressing of the lever.

4. The binder of claim 1, wherein the lock and the binding member are of unitary construction.

5. The binder of claim 1, base, wherein:

(a) the binding member has a base end connected with the base and a locking portion lockable to the lock;

(b) the base has a base longitudinal axis extending parallel to the loop and by the base end and locking portion; and (c) the lock and lever are connected and disposed such that the unlocking direction is oriented at an unlocking angle to the base longitudinal axis.

6. The binder of claim 5, wherein the unlocking angle is greater than about 45 degrees.

7. The binder of claim 5, wherein the unlocking direction is directed generally towards the panel.

8. The binder of claim 5, wherein the unlocking direction is substantially parallel to the panel.

9. The binder of claim 1, wherein the lever is configured for operation with a single finger for operating the lock.

10. The binder of claim 1, further comprising a guiding portion, wherein the binding member has a lockable portion with a free end, the lockable portion being releasably lockable with the lock receivable adjacent the lock, and the guiding portion is configured for guiding the lockable and free end portion into locked association with the lock in the closed position.

11. The binder of claim 10, wherein the guiding portion and the lock are of unitary construction.

12. The binder of claim 1, further comprising a base mounted to the panel, wherein:

(a) the binding member has a base end connected with the base and a lock end lockable to the lock; and (b) the lever and lock are pivotably connected to the base for operation of the lock.

13. The binder of claim 1, wherein the lock is disposed in the base.

14. The binder of claim 1, wherein:

(a) the panel has a panel edge adjacent to which the fastener is attached; and (b) the binding member has a base end connected to the base at a base location and has a free portion received in the base at a received location in the closed position, the base location being disposed further from the panel edge than the received location.

15. The binder of claim 1, wherein:

(a) the panel has a panel edge adjacent to which the faster; and (b) the lever is disposed on a side of the loop adjacent the panel edge.

16. The binder of claim 1, further comprising a second panel attached to the first panel adjacent the panel edge.

17. The binder of claim 1, wherein the binding member has a locking portion releasably lockable to the lock, the locking portion and the lock being configured for locking in snap-fit association when the binding member is moved into said locking association in the closed position.

18. The binder of claim 1, wherein the binding member has a locking end that is releasably lockable to the lock, the lock end and the lock being configured for locking upon biasing the locking end into the lock.

19. The binder of claim 1, wherein the lock is configured for releasing the binding member from the closed position upon simple depressing of the lever.

20. The binder of claim 1, wherein the binding member has a locking tab extending therefrom in said releasable locking association with the lock.

21. The binder of claim 1, wherein the lock is configured for retaining the binding member in said locking association independent from the first panel.

22. The binder of claim 1, wherein the base is substantially stiff.

23. The binder of claim 1, wherein the lever is spaced from the panel such that the lever is movable closer to the panel for operating the lock.

24. The binder of claim 23, wherein the lever comprises a button depressible to operate the lock.

25. A binder, comprising:

(a) a first panel; and (b) at least one fastener and comprising:

(i) a base attached to the panel;

(ii) a binding member positionable in a closed position defining a closed loop together with the base, and in an open position in which the loop is open for mounting and dismounting sheets thereto, wherein the binding member is releasably lockable to the base in the closed position, and the base includes a surface defining the inside of the loop, the surface comprising a recessed portion and an elevated portion adjacent each other.

26. The binder of claim 25, wherein the binding member has a portion that meets the base adjacent the elevated portion and remotely from the recessed portion.

27. A binder, comprising:

(a) a first panel; and (b) at least one fastener and comprising:

(i) a binding member positionable in a closed position defining a closed loop, and in an open position in which the loop is open for mounting and dismounting sheets thereto, (ii) a lock disposed in close proximity with the base and being in releasable locking association with the binding member in the closed position, and (iii) first and second levers operatively connected with the lock such that squeezing the levers towards each other causes the lock to release the binding member from the closed position.

* * * * *